United States Patent [19]

Carr, Jr.

[11] Patent Number: 4,491,356

[45] Date of Patent: Jan. 1, 1985

[54] SLEEVE STYLE PACKAGE HOLDER

[75] Inventor: William H. Carr, Jr., West Chester, Pa.

[73] Assignee: Container Corporation of America, Chicago, Ill.

[21] Appl. No.: 428,984

[22] Filed: Sep. 30, 1982

[51] Int. Cl.[3] ..... A47B 95/02

[52] U.S. Cl. ..... 294/31.2; 294/27 H; 229/52 B; 229/1.5 H; 229/DIG. 6

[58] Field of Search ..... 294/31.2, 27 H, 32, 294/31 A; 16/114 R; 220/85 H; 229/1.5 H, 52 B, DIG. 6

[56] References Cited

U.S. PATENT DOCUMENTS 3,104,788 9/1963 Wood ..... 294/31.2
4,296,958 10/1981 Stranders ..... 294/27 H

FOREIGN PATENT DOCUMENTS 1279793 10/1968 Fed. Rep. of Germany ..... 294/31.2

*Primary Examiner*—James B. Marbert
*Attorney, Agent, or Firm*—Richard W. Carpenter

[57] ABSTRACT

A sleeve style package holder formed of paperboard and including an integral, open, strap-type handle secured to one side thereof.

8 Claims, 9 Drawing Figures

SLEEVE STYLE PACKAGE HOLDER

BACKGROUND OF THE INVENTION

1. Field of the Invention

This invention relates to folding cartons and more particularly to a one-piece, sleeve style, carton holder with an integral handle which may be used to hold an inner folding carton formed of paperboard or other material.

A holder of this type is particularly useful for holding a thin flexible inner carton filled with a liquid material, such as an aseptic package of the type used in the pharmaceutical field. Packages of this type are sometime so thin that it is extremely difficult to pour out of the package, because when one grasps the package the walls of the package tend to collapse and cause premature spilling of the contents.

2. Description of the Prior Art

A prior art search in the United States Patent and Trademark Office directed to the subject matter of this invention disclosed the following U.S. Pat. Nos. 133,129; 2,184,854; 2,454,906; 2,670,616; 2,691,471; 2,848,154; 2,936,068; 2,936,927; 2,954,901; 3,112,856; 3,141,599; 3,160,326; 3,241,738; 3,250,562; 3,346,167; 3,416,719; 3,495,760; 3,763,522; 4,017,015; 4,286,714.

None of the prior art patents uncovered in the search discloses a one-piece, collapsible, sleeve-type holder having an integral, open, strap-type handle and adapted to hold an inner package by frictional engagement only, without the necessity of any adhesive or interlocking connection therebetween.

SUMMARY OF THE INVENTION

An object of the present invention is to provide a one-piece sleeve-type holder having an integral handle and adapted to hold an inner package without any securing means other than mere frictional engagement between the holder and the package.

A more specific object of the invention is the provision, in a holder of the type described, of a unique integral, open, strap-type handle to facilitate utilizing the holder in pouring the contents of the inner package therefrom.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENTS

Figure 3:
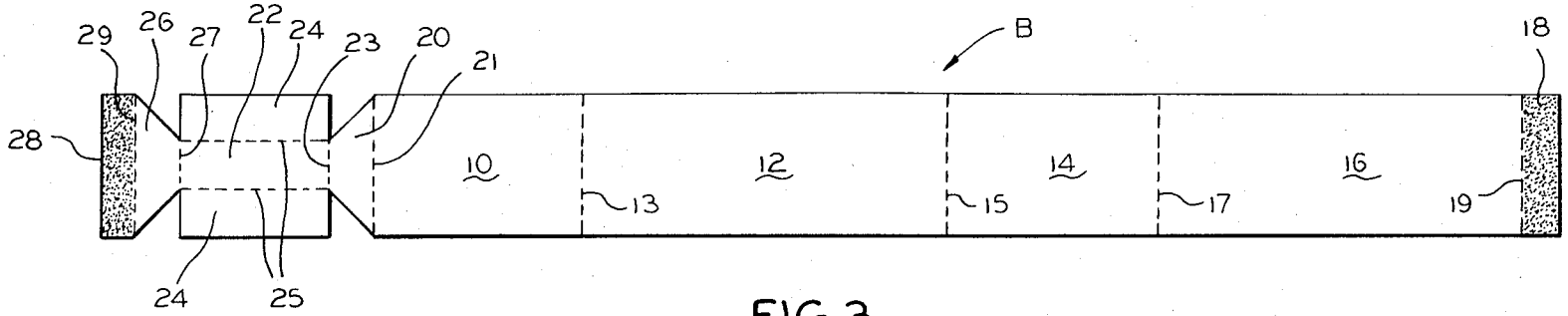
FIG. 3 is a plan view of a blank of foldable sheet material from which the holder illustrated in FIG. 2 may be formed.
Figure 1:
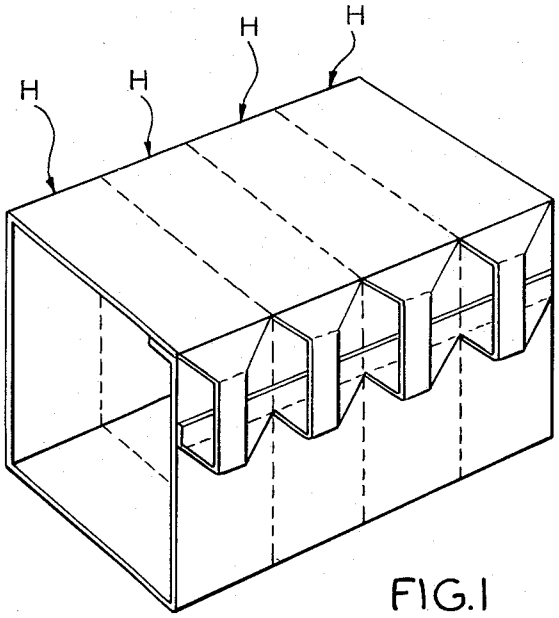
FIG. 1 is a perspective view of a plurality of sleeve-type holders embodying features of the invention, as shown prior to detachment from each other.
Figure 2:
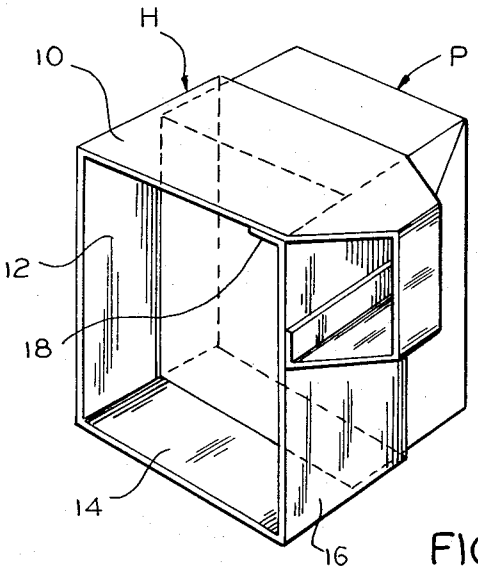
FIG. 2 is an enlarged perspective view of one of the sleeve-type holders illustrated in FIG. 1, and illustrate the relationship of the holder to an inner package.

Referring now to the drawings for a better understanding of the invention, and particularly to FIGS. 1 and 2, it will be seen that the novel sleeve-type holder, indicated generally at H, is adapted to hold an inner package, indicated generally at P, and may formed from the unitary blank B of foldably sheet material, such as paperboard, illustrated in FIG. 3 of the drawings.

As seen in FIG. 1, a plurality of holders can be formed from a single sheet of material and detachably connected to each other along weakened lines of tear.

As best seen in FIGS. 2 and 3, holder H includes a body having a top end wall 10, a rear side wall 12, a bottom end wall 14, a front side wall 16, and a glue flap 18, which are foldably joined to each other along fold lines 13, 15, 17, and 19, respectively, with glue flap 18 being secured to the inner surface of top end wall 10 to form a rectilinear, tubular, body structure adapted to receive an inner carton or package indicated generally at P.

Holder H includes an integral handle which comprises a plurality of panels foldably joined to each other and to the body of the holder.

The integral handle of the holder includes a preferably trapezoidal-shaped upper panel 20 which is foldably joined on fold line 21 to the forward edge of body portion top end wall 10. Foldably joined to the forward edge of upper panel 20 along fold line 23 is a front panel 22 which has foldably joined to its lower edge on fold line 27 a lower panel 26 which is also preferably trapezoidal and which has foldably joined to its rear edge on fold line 29 a rear panel 28. Panel 28 is adhesively secured to the front side of body front side wall 16 to form therewith an open or strap-type handle which is collapsible with the body of the holder for shipping purposes.

In order to strengthen the handle, front panel 22 may have a pair of side sections 24 which are foldably joined to opposite side edges thereof on fold lines 25. Side sections 24 can be folded behind panel 22 and adhesively secured to it and to each other if so desired.

In the remaining figures of the drawings slightly modified forms of the invention are shown. In each case portions of the structure corresponding to those of the previous described embodiment have been illustrated with or corresponding numerals and will not be explained in great detail. The primary diffeences between the various embodiment resides in the handle construction.

Figure 5:
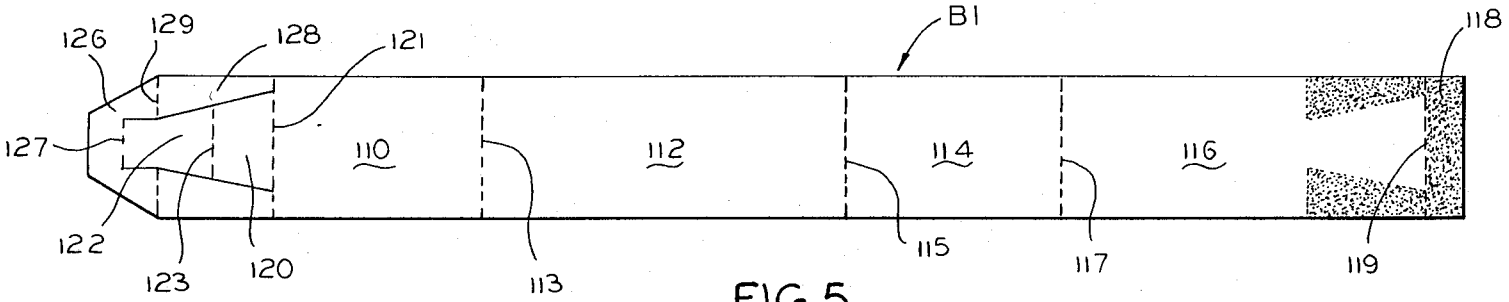
FIGS. 4 and 5 are views similar to FIGS. 2 and 3 but illustrate a modified form of the invention.
Figure 4:
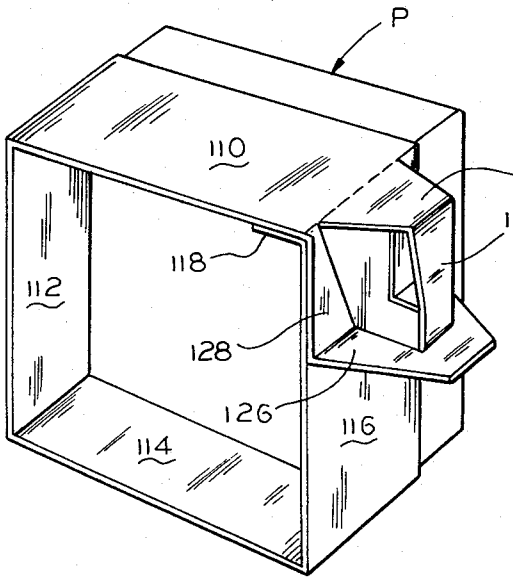

In the embodiment illustrated in FIGS. 4 and 5, it will be seen that handle upper panel 120 and front panel 122 are formed from material cut from rear panel 128 and lower panel 126, will rear panel 128 and upper panel 120 being foldably joined along a common fold line 121 to the forward edge of holder body top end wall 110. Rear panel 128 is preferably adhesively secured to the front surface of body front side wall 116.

Figure 7:
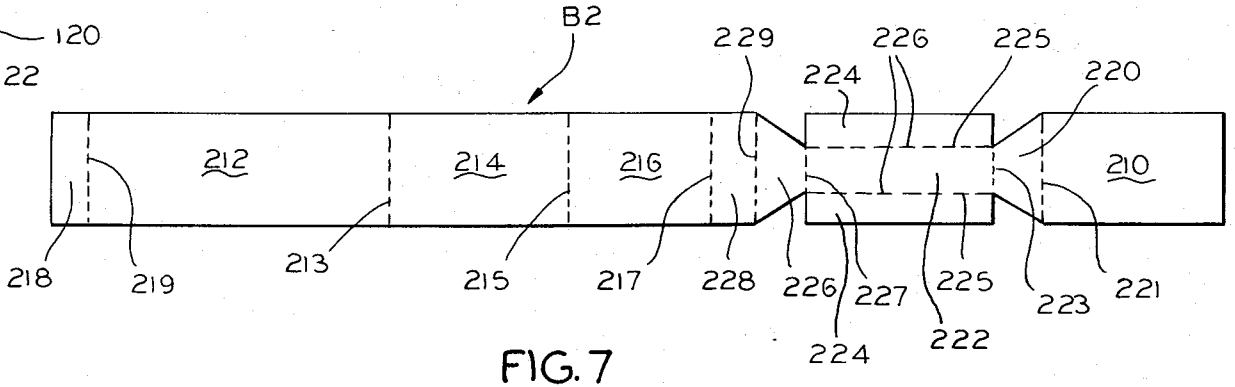
FIGS. 6 and 7 are also views similar to FIGS. 2 and 3 but illustrate another form of the invention.
Figure 6:
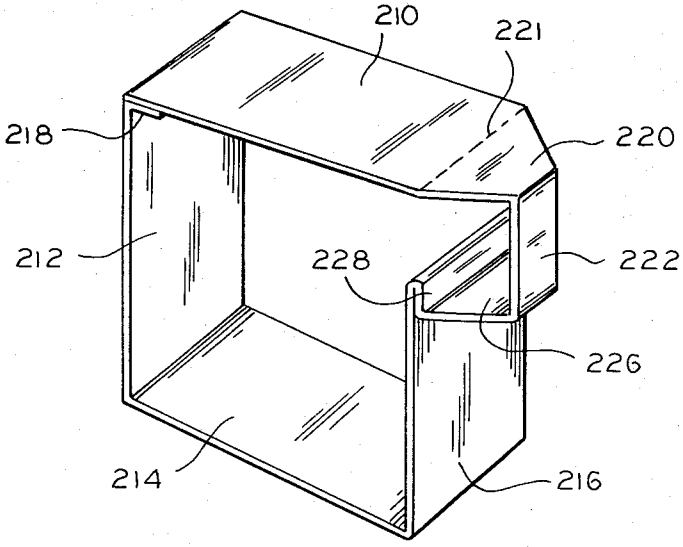

In the embodiment illustrated in FIGS. 6 and 7, the handle upper panel 220, front panel 222, and lower panel 226 are similar to comparable structure of the embodiment of FIGS. 2 and 3. However, in this embodiment handle rear panel 228 is of a lesser height than handle front panel 222 and is foldably joined at its upper edge to an upper edge of body front side wall 216 along a fold line 229.

Figure 9:
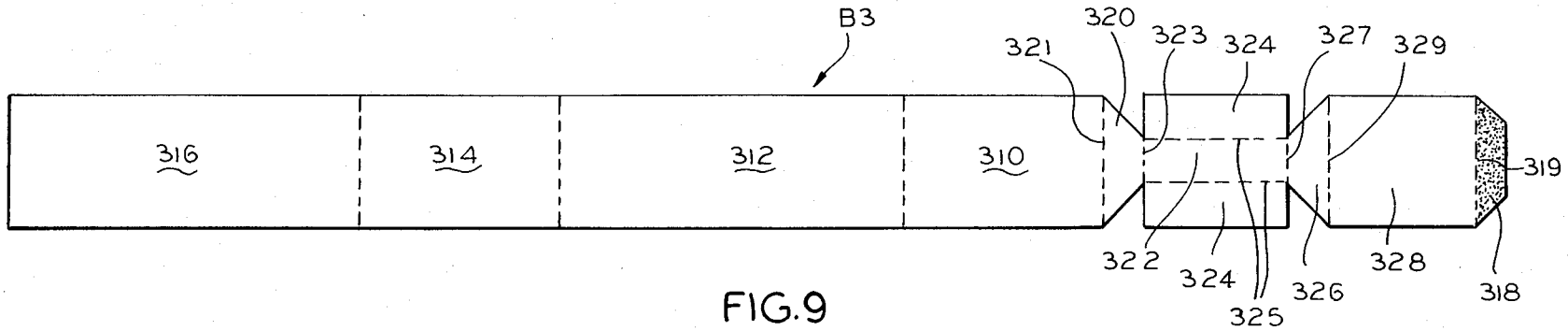
FIGS. 8 and 9 are views similar to FIGS. 2 and 3 but illustrate still one other form of the invention.
Figure 8:
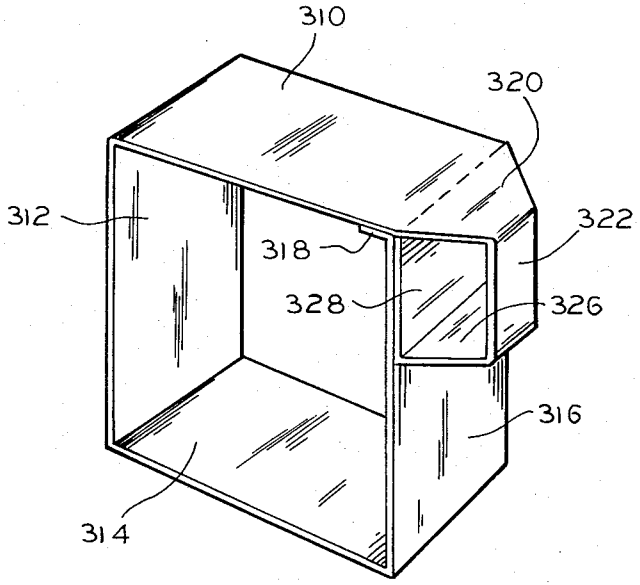

In the embodiment illustrated in FIGS. 8 and 9, the structure is quite similar to that of the structure of FIGS. 2 and 3, with the handle comprising an upper panel 320, a front panel 322 a lower panel 326, and a rear panel 328.

In this embodiment, however, handle rear panel 328 is of the same height as front panel 322 and is adhesively secured to the front surface of body front side wall 316.

Handle rear panel 328 also has foldably joined to its upper edge along fold line 319 a glue flap 318 which may be secured to the inner surface of body top end wall 310.

Thus, it will be appreciated that all of the embodiments of the invention incorporate the same basic features, namely, a sleeve-type holder having an integral, open, strap-type handle which permits the holder to be used for emptying the contents of an inner package carried within the holder and secured by frictional engagement only without requiring outside securing means such as adhesives or interlocking connections.

What is claimed is:

1. A collapsible, open sided sleeve style holder, formed of a unitary blank of foldable sheet material such as paperboard, for receiving and supporting, by frictional engagement only, an inner package, said holder having an integral handle and comprising:

(a) front and rear side walls and top and bottom end walls foldably joined to each other to form a rectilinear, tubular, body structure;

(b) an integral, open, strap-type handle structure which can be collapsed and folded to lie against said holder front side wall comprising:

(i) an upper panel foldably joined to and extending forwardly from said body structure top end wall;

(ii) a front panel foldably joined to and extending downwardly from the forward edge of said upper panel;

(iii) a lower panel foldably joined to and extending rearwardly from a lower edge of said front panel;

(iv) a rear panel foldably joined to and extending upwardly from a rear edge of said lower panel;

(v) means joining said handle structure rear panel to said body structure front wall.

2. A holder according to claim 1, wherein said handle structure rear panel is disposed in face-to-face relation with said body structure front wall.

3. A holder according to claim 1, wherein handle structure rear panel is adhesively secured in face-to-face relation with said body structure front wall.

4. A holder according to claim 1, wherein said handle structure rear panel is foldably joined at its upper edge to an upper edge of said body structure front wall.

5. A holder according to claim 1, wherein said handle structure front panel includes three layers of material.

6. A holder according to claim 1, wherein said handle structure upper and lower panels are trapezoidal in shape.

7. A holder according to claim 1, wherein said handle structure front and rear panels are of the same height.

8. A holder according to claim 1, wherein said handle structure upper and front panels are cut from material of said handle structure rear and lower panels.

* * * * *